US006658970B2

(12) United States Patent
Shiao

(10) Patent No.: US 6,658,970 B2
(45) Date of Patent: Dec. 9, 2003

(54) RATCHET SCREWDRIVER

(76) Inventor: Hsuan-Sen Shiao, No. 15-1, Lane 369, Min-Chuan Rd, Taichung City (TW)

( * ) Notice: Subject to any disclaimer, the term of this patent is extended or adjusted under 35 U.S.C. 154(b) by 161 days.

(21) Appl. No.: 10/014,587

(22) Filed: Dec. 14, 2001

(65) Prior Publication Data

US 2003/0110901 A1 Jun. 19, 2003

(51) Int. Cl.[7] ..... B25B 13/46
(52) U.S. Cl. ..... 81/62; 81/63.1; 192/43.1
(58) Field of Search ..... 81/60, 62, 63.1; 192/43.1

(56) References Cited

U.S. PATENT DOCUMENTS

| | | | | |
|---|---|---|---|---|
| 2,022,775 A | | 12/1935 | Holland-Letz | |
| 2,720,296 A | * | 10/1955 | Briglia | 192/43.1 |
| 4,399,723 A | | 8/1983 | Marleau | |
| 5,499,562 A | | 3/1996 | Feng | |
| 5,875,692 A | | 3/1999 | Lin | |
| 5,899,127 A | | 5/1999 | Shiao | |
| 5,964,132 A | | 10/1999 | Chen | |
| 5,967,003 A | | 10/1999 | Lin | |
| 6,076,432 A | | 6/2000 | Chang | |
| 6,151,994 A | | 11/2000 | Shiao | |
| D438,083 S | | 2/2001 | Shiao | |
| D440,140 S | | 4/2001 | Shiao | |
| 6,349,619 B1 | * | 2/2002 | Liao | 81/62 |
| 2002/0194964 A1 | * | 12/2002 | Huang | 81/62 |

* cited by examiner

*Primary Examiner*—James G. Smith
(74) *Attorney, Agent, or Firm*—Baker Botts L.L.P.

(57) ABSTRACT

A ratchet screwdriver includes a drive shaft inserted into a shaft-receiving space of a shaft-mounting seat, a regulator sleeved rotatably around one end of the shaft-mounting seat to selectively push two pawls that are mounted in the shaft-receiving space, and a handle fixed on the shaft-mounting seat. The pawls selectively engage a ratchet wheel fixed on the drive shaft when the regulator is moved to first and second angular positions relative to the shaft-mounting seat.

4 Claims, 7 Drawing Sheets

RATCHET SCREWDRIVER

BACKGROUND OF THE INVENTION

1. Field of the Invention

The present invention relates to a ratchet screwdriver, more particularly to a ratchet screwdriver which has an orientation regulator that is turnable between first and second angular positions so as to permit clockwise and counterclockwise driving rotations of a drive shaft.

2. Description of the Related Art

U.S. Pat. No. 6,151,994 discloses a ratchet screwdriver that includes a handle defining a ratchet shaft receiving hole therethrough, and a ratchet shaft disposed therein. The ratchet shaft has a ratchet wheel mounted securely between first and second end portions. An engaging unit is interposed between the ratchet shaft and a drive shaft inserted in the first or second end portion to prevent relative axial displacement and permit co-rotation therebetween. A ratchet housing includes a coupling portion sleeved on the ratchet shaft and coupled to the handle for co-rotation therewith, a wheel confining portion defining a cavity for enclosing the ratchet wheel, and a shoulder between the coupling and wheel confining portions. The wheel confining portion is formed with a pawl-retaining groove in communication with the cavity to receive a pawl member which is mounted pivotally on the shoulder and which extends radially into the cavity. A biasing member biases the pawl member to engage the ratchet wheel such that when the handle is driven in a counterclockwise direction, the ratchet and drive shafts correspondingly rotate in the counterclockwise direction.

One disadvantage of the aforesaid ratchet screwdriver resides in that when it is desired to rotate the drive shaft in a clockwise direction, the handle is turned 180 degrees along a radial line to reverse positions of the first and second end portions of the ratchet shaft, and the drive shaft is disassembled and then re-assembled to a selected one of the first and second end portions of the ratchet shaft to permit driving rotation of the handle in the clockwise direction.

SUMMARY OF THE INVENTION

Therefore the object of the present invention is to provide a ratchet screwdriver which can solve the aforementioned problem.

Accordingly, the ratchet screwdriver of the present invention includes a drive shaft, a shaft-mounting seat, an elongated handle, and a ratchet assembly. The drive shaft defines a first axis, and has a coupling section, and an operating section which extends axially from the coupling section and which defines a tool-retaining hole with a non-circular cross-section. The shaft-mounting seat includes a peripheral wall that defines a shaft-receiving space to receive the coupling section of the drive shaft therein, and that has front and rear ends, and an upper wall portion formed with two spaced apart opposing spring-retaining recesses in spatial communication with the shaft-receiving space, and two spaced apart opposing pawl-limiting through-holes which are disposed between the spring-retaining recesses. Each of the pawl-limiting through-holes is confined by a hole-confining wall. The shaft-mounting seat further includes front and rear end flanges that extend inwardly and respectively from the front and rear ends of the peripheral wall in a transverse direction relative to the peripheral wall. The coupling section of the drive shaft extends through the front end flange, the shaft-receiving space, and the rear end flange.

The handle is securely connected to the rear end of the shaft-mounting seat. The ratchet assembly includes a ratchet wheel, opposing left and right pawls, opposing left and right biasing members, a regulator in the form of a tubular sleeve, and a positioning unit. The ratchet wheel is disposed around and is connected securely to the coupling section of the drive shaft for co-rotation therewith in the shaft-receiving space, and has a plurality of engaging teeth formed circumferentially therearound. Each of the left and right pawls is disposed in the shaft-receiving space among the drive shaft, a respective one of the spring-retaining recesses, and a respective one of the pawl-limiting through-holes. Each of the left and right pawls has two opposite pivot ends respectively pivoted to the front and rear end flanges, a teeth-engaging portion between the pivot ends, and an actuating portion which projects from the teeth-engaging portion through a respective one of the pawl-limiting through-holes. The pivot ends of each of the left and right pawls are limitedly turnable relative to the shaft-mounting seat about a second axis that is parallel to the first axis and so as to be turnable about the first axis together with the shaft-mounting seat. The left and right biasing members are disposed in the spring-retaining recesses, respectively, for urging the teeth-engaging portions of the left and right pawls to releasably mesh with the engaging teeth of the ratchet wheel. The tubular sleeve is sleeved rotatably around the peripheral wall of the shaft-mounting seat, and has an inner wall that is formed with a sector-shaped recess defined by a recess-confining wall. The tubular sleeve is turnable about the first axis relative to the shaft-mounting seat between a first angular position, where the actuating portion of the left pawl is pushed by the recess-confining wall of the tubular sleeve against biasing action of the left biasing member so as to turn about the second axis to abut against the hole-confining wall of the respective one of the pawl-limiting through-holes and so as to permit the teeth-engaging portion of the left pawl to disengage from the engaging teeth of the ratchet wheel, and where the teeth-engaging portion of the right pawl engages the teeth of the ratchet wheel, and a second angular position opposite to the first angular position, where the actuating portion of the right pawl is pushed by the recess-confining wall of the tubular sleeve against biasing action of the right biasing member so as to turn about the second axis to abut against the hole-confining wall of the other one of the pawl-limiting through-holes and so as to permit the teeth-engaging portion of the right pawl to disengage from the engaging teeth of the ratchet wheel, and where the teeth-engaging portion of the left pawl engages the engaging teeth of the ratchet wheel. The positioning unit is disposed between the shaft-mounting seat and the tubular sleeve for releasably engaging the shaft-mounting seat and the tubular sleeve once the tubular sleeve is moved to the first and second angular positions. As such, when the tubular sleeve is moved to the first angular position, rotation of the handle in a clockwise direction results in synchronous rotation of the shaft-mounting seat and the drive shaft in the clockwise direction, and rotation of the handle in a counterclockwise direction results in idle rotation of the handle relative to the drive shaft. Accordingly, when the tubular sleeve is moved to the second angular position, rotation of the handle in the counterclockwise direction results in synchronous rotation of the shaft-mounting seat and the drive shaft in the counterclockwise direction, and rotation of the handle in the clockwise direction results in idle rotation of the handle relative to the drive shaft.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
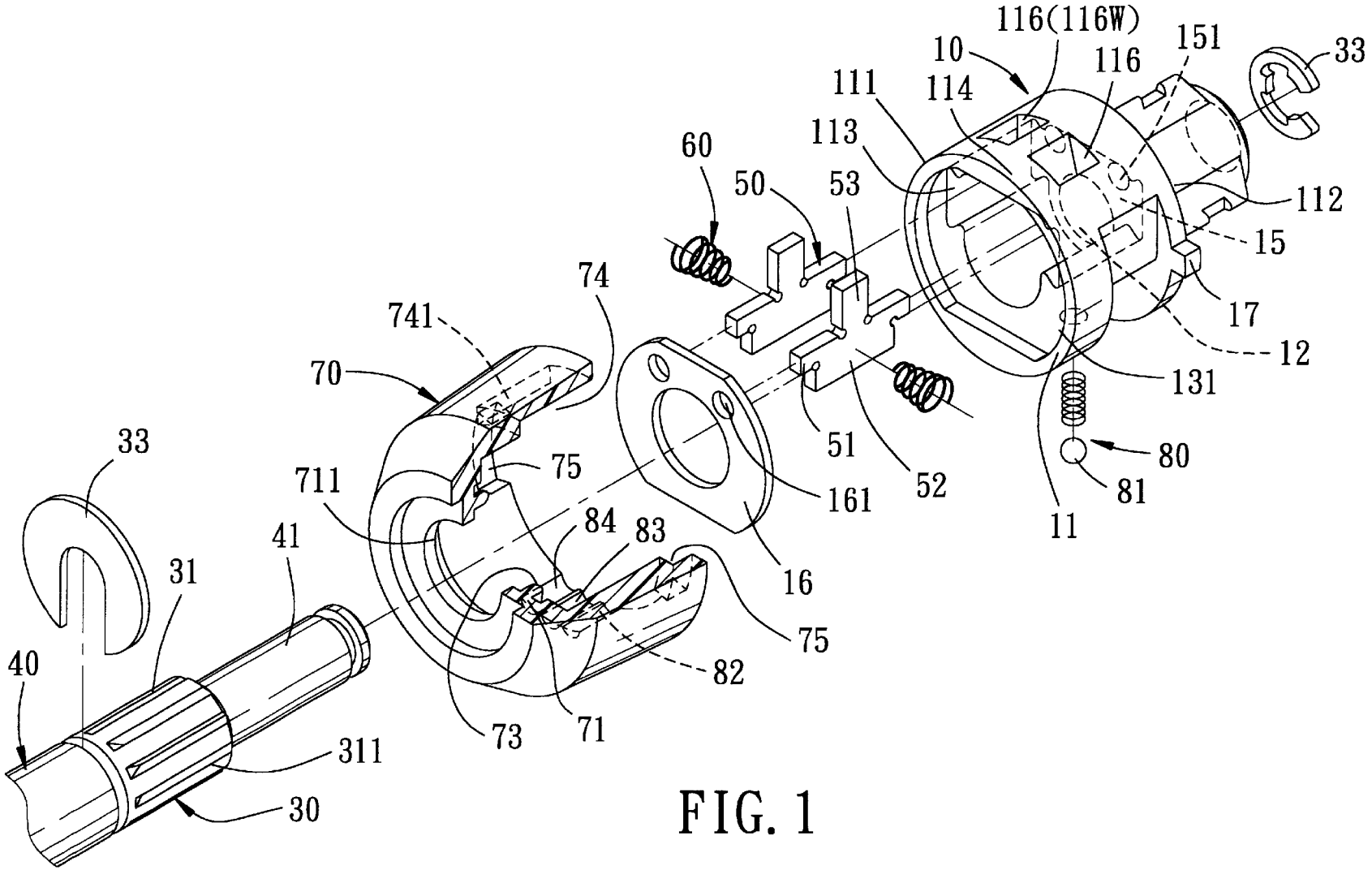
FIG. 1 is a fragmentary exploded perspective view of a preferred embodiment of a ratchet screwdriver according to the present invention.

Before the present invention is described in greater detail with reference to the following preferred embodiments, it should be noted that same reference numerals have been used to denote similar elements throughout the specification.

Figure 2:
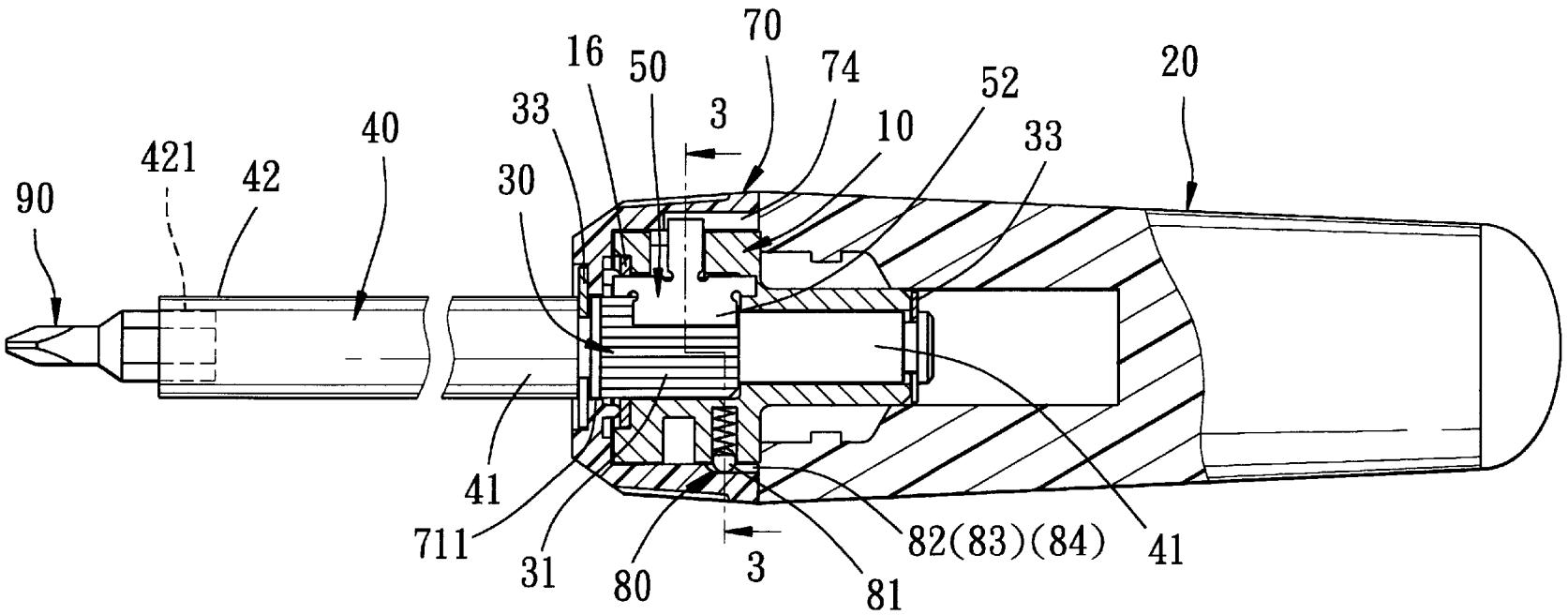
FIG. 2 is a fragmentary sectional view of the preferred embodiment.
Figure 3:
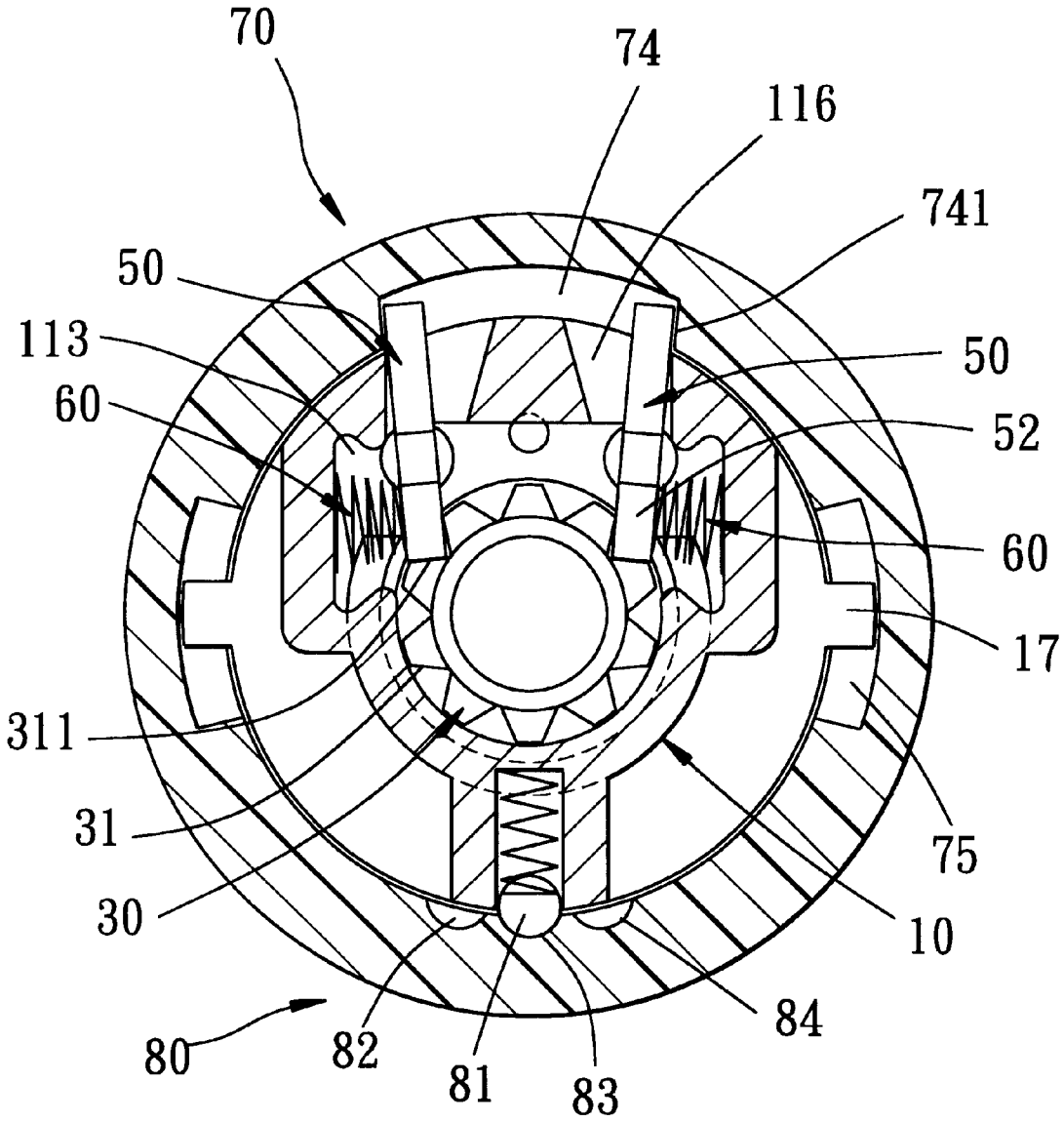
FIG. 3 is a cross-sectional view of the preferred embodiment taken along lines III—III in FIG. 2.

Referring to FIGS. 1, 2 and 3, a preferred embodiment of a ratchet screwdriver according to the present invention is shown to include a drive shaft 40, a shaft-mounting seat 10, an elongated handle 20, and a ratchet assembly 30.

As illustrated, the drive shaft 40 defines a first axis, has a coupling section 41, and an operating section 42 which extends axially from the coupling section 41 and which defines a tool-retaining hole 421 with a non-circular cross-section to receive a tool-bit 90 therein.

The shaft-mounting seat 10 includes a peripheral wall 11 that defines a shaft-receiving space 12 to receive the coupling section 41 of the drive shaft 40 therein, and that has front and rear ends 111, 112, and an upper wall portion 114 formed with two spaced apart opposing spring-retaining recesses 113 in spatial communication with the shaft-receiving space 12, and two spaced apart opposing pawl-limiting through-holes 116 which are disposed between the spring-retaining recesses 113. Each of the pawl-limiting through-holes 116 is confined by a hole-confining wall 116W. The shaft-mounting seat 10 further includes front and rear end flanges 16, 15 that extend inwardly and respectively from the front and rear ends 111, 112 of the peripheral wall 11 in a transverse direction relative to the peripheral wall 11. The coupling section 41 of the drive shaft 40 extends through the front end flange 16, the shaft-receiving space 12, and the rear end flange 15, and is fastened to the shaft-mounting seat 10 via two C-shaped retainer rings 33 so as to be prevented from axial removal from the shaft-mounting seat 10.

The handle 20 is connected securely to the rear end 112 of the shaft-mounting seat 10 so that the shaft-mounting seat 10 co-rotates with the handle 20 in case the handle 20 is rotated.

The ratchet assembly 30 includes a ratchet wheel 31, opposing left and right pawls 50, opposing left and right biasing members 60, a regulator in the form of a tubular sleeve 70, and a positioning unit 80. The ratchet wheel 31 is disposed around and is connected securely to the coupling section 41 of the drive shaft 40 for co-rotation therewith in the shaft-receiving space 12, and has a plurality of engaging teeth 311 formed circumferentially therearound. Each of the left and right pawls 50 is disposed in the shaft-receiving space 12 among the drive shaft 40, a respective one of the spring-retaining recesses 113, and a respective one of the pawl-limiting through-holes 116. Each of the left and right pawls 50 has two opposite pivot ends 51 pivoted to circular holes 161, 151 in the front and rear end flanges 16, 15, a teeth-engaging portion 52 between the pivot ends 51, and an actuating portion 53 that projects from the teeth-engaging portion 52 through a respective one of the pawl-limiting through-holes 116. The pivot ends 51 of each of the left and right pawls 50 are limitedly turnable relative to the shaft-mounting seat 10 about a second axis that is parallel to the first axis and so as to be turnable about the first axis together with the shaft-mounting seat 10.

The left and right biasing members 60 are respectively disposed in the spring-retaining recesses 113 of the shaft-mounting seat 10 for urging the teeth-engaging portions 52 of the left and right pawls 50 to releasably mesh with the engaging teeth 311 of the ratchet wheel 31.

Figure 4:
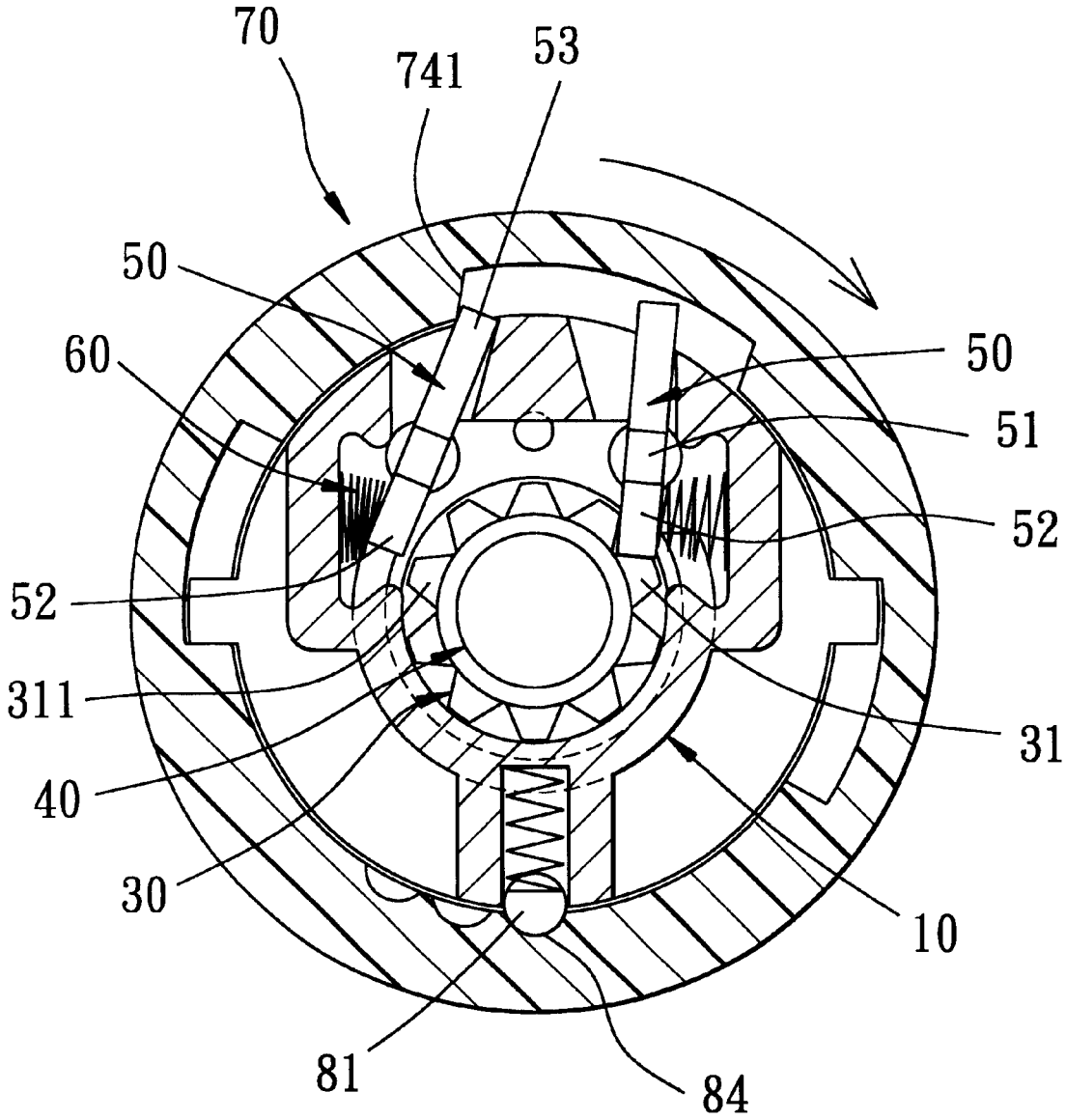
FIG. 4 is a cross-sectional view of the preferred embodiment taken along lines III—III in FIG. 2 when turned in a clockwise direction during use.
Figure 5:
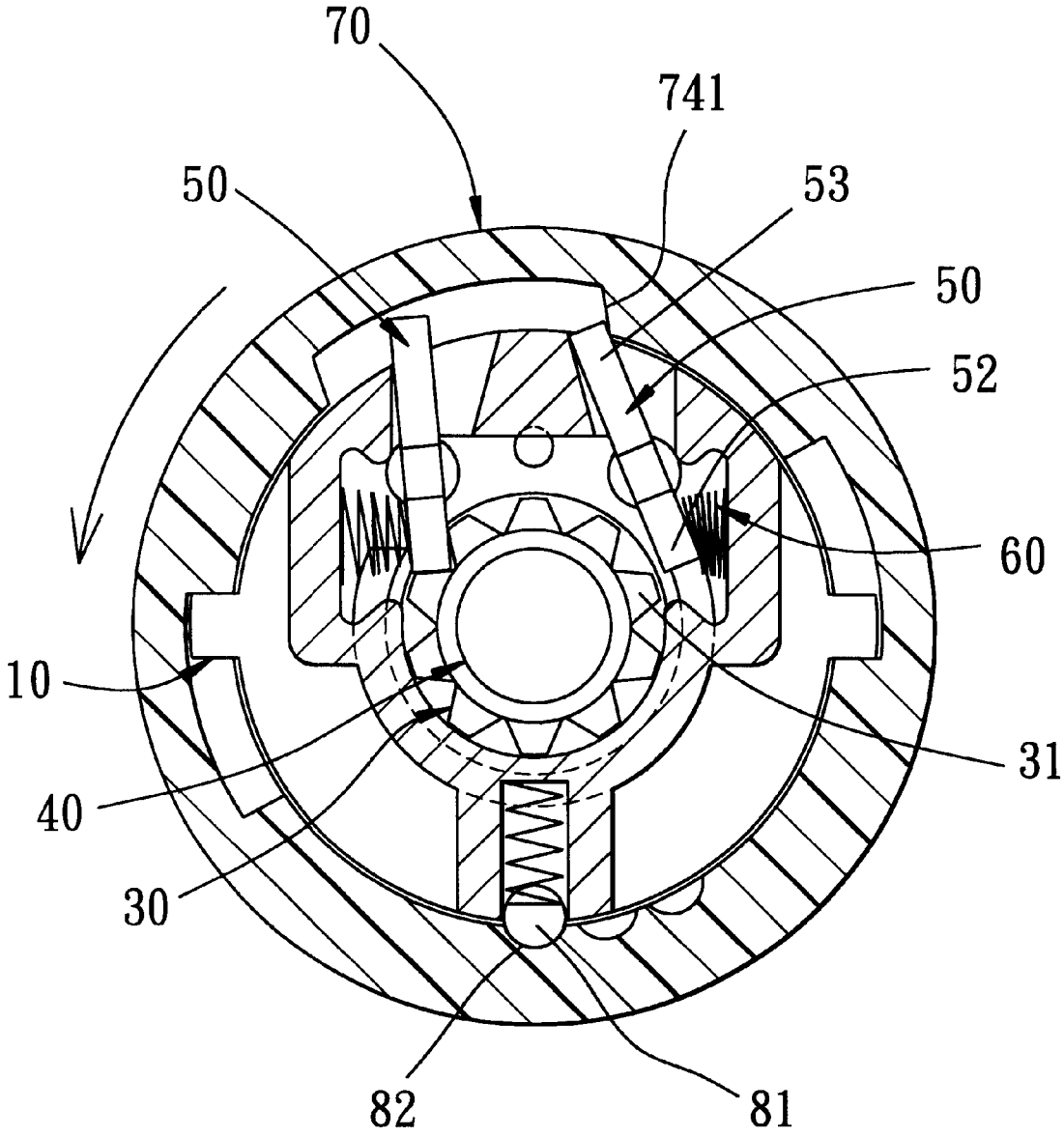
FIG. 5 is a cross-sectional view of the preferred embodiment taken along lines III—III in FIG. 2 when turned in a counterclockwise direction during use.

The tubular sleeve 70 is sleeved rotatably around the peripheral wall 11 of the shaft-mounting seat 10, and defines an axial hole 711 to permit extension of the operating section 42 of the drive shaft 40 therethrough. The tubular sleeve 70 has an inner wall 71 that is formed with a sector-shaped recess 74 defined by a recess-confining wall 741. The tubular sleeve 70 is turnable about the first axis relative to the shaft-mounting seat 10 between a first angular position, as best shown in FIG. 4, where the actuating portion 53 of the left pawl 50 is pushed by the recess-confining wall 741 of the tubular sleeve 70 against biasing action of the left biasing member 60 so as to turn about the second axis to abut against the hole-confining wall 116W of the respective one of the pawl-limiting through-holes 116 and so as to permit the teeth-engaging portion 52 of the left pawl 50 to disengage from the engaging teeth 311 of the ratchet wheel 31, and where the teeth-engaging portion 52 of the right pawl 50 engages the engaging teeth 311 of the ratchet wheel 31, and a second angular position opposite to the first angular position, as best shown in FIG. 5, where the actuating portion 53 of the right pawl 50 is pushed by the recess-confining wall 741 of the tubular sleeve 70 against biasing action of the right biasing member 50 so as to turn about the second axis to abut against the hole-confining wall 116W of the other one of the pawl-limiting through-holes 116 and so as to permit the teeth-engaging portion 52 of the right pawl 50 to disengage from the engaging teeth 311 of the ratchet wheel 31, and where the teeth-engaging portion 52 of the left pawl 50 engages the engaging teeth 311 of the ratchet wheel 31. Preferably, the rear end flange 15 is integrally formed with the rear end 112 of the peripheral wall 11. The front end flange 16 is mounted securely in a flange-receiving groove 131 defined by the peripheral wall 11 adjacent to the front end 111 thereof. The tubular sleeve 70 has an annular flange-retention rib 73 which projects inwardly and axially from a periphery of a front open end of the tubular sleeve 70 to abut against the front end flange 16 and prevent removal of the front end flange 16 from the shaft-mounting seat 10.

The positioning unit 80 is disposed between the shaft-mounting seat 10 and the tubular sleeve 10 for releasably engaging the shaft-mounting seat 10 and the tubular sleeve 70 once the tubular sleeve 70 is moved to the first and second angular positions. As such, when the tubular sleeve 70 is moved to the first angular position of FIG. 4, rotation of the handle 20 in a clockwise direction (shown by the headed arrow in FIG. 4) results in synchronous rotation of the shaft-mounting seat 10 and the drive shaft 40 in the clockwise direction, and rotation of the handle 10 in a counterclockwise direction results in idle rotation of the handle 10 relative to the drive shaft 40. Accordingly, when the tubular sleeve 70 is moved to the second angular position of FIG. 5, rotation of the handle 20 in the counterclockwise direction (shown by the headed arrow in FIG. 5) results in synchronous rotation of the shaft-mounting seat 10 and the drive shaft 40 in the counterclockwise direction, and rotation of the handle 10 in the clockwise direction results in idle rotation of the handle 10 relative to the drive shaft 10.

Preferably, the inner wall 71 of the tubular sleeve 70 is further formed with spaced apart left and right engaging grooves 82, 84 which are disposed at a position opposite to the sector-shaped recess 74, and an intermediate engaging groove 83 between the left and right engaging grooves 82, 84. The positioning unit 80 includes a spring-loaded ball 81 which is mounted on shaft-mounting seat 10 and which engages the right engaging groove 84 when the tubular sleeve 70 is moved to the first angular position and which engages the left engaging groove 82 when the tubular sleeve 70 is moved to the second angular position.

The inner wall 71 of the tubular sleeve 70 is further formed with a pair of diametrically disposed limiting grooves 75 at two opposite sides of the sector-shaped recess 74. The shaft-mounting seat 10 further includes a pair of opposing limiting tabs 17 which radially and outwardly project from the peripheral wall 11 and which extend into the limiting grooves 75, respectively, so as to limit angular rotation of the tubular sleeve 70 to the first and second angular positions relative to the shaft-mounting seat 10.

Figure 6:
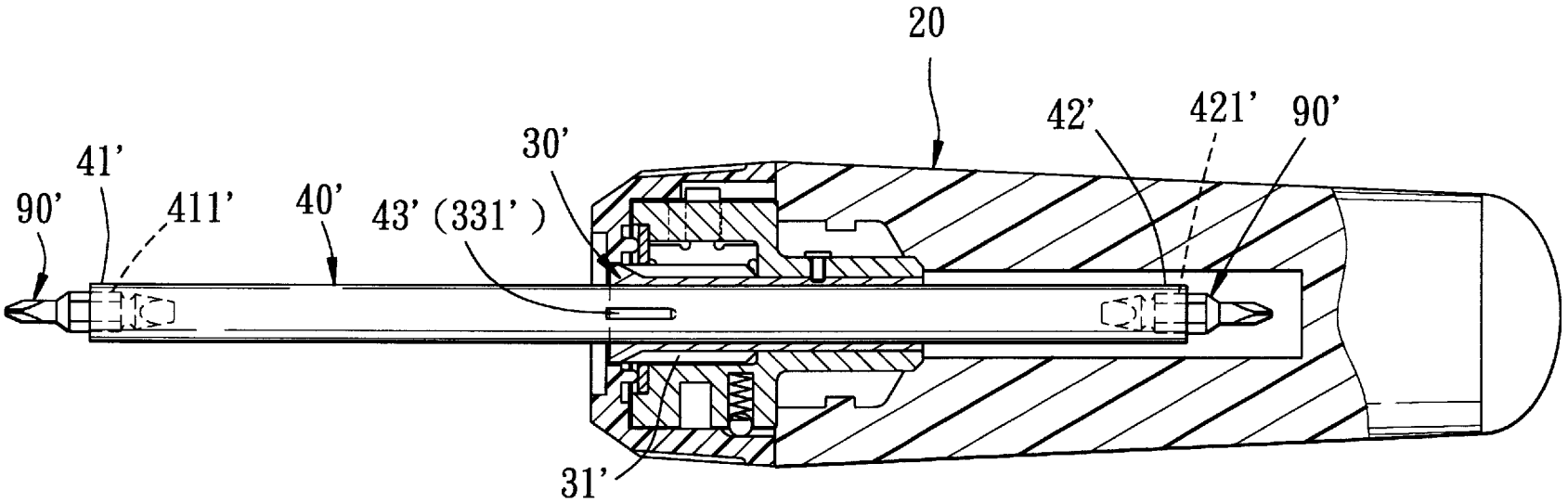
FIG. 6 is a fragmentary sectional view of a modified preferred embodiment according to the present invention.

Referring to FIG. 6, a modified preferred embodiment of the present invention is shown to have a structure similar to that of the previous embodiment. The main difference resides in that two opposite end portions 41', 42' of the drive shaft 40' define two bit-retaining holes 411', 421' with a non-circular cross-section to receive tool-bits 90' of different configurations for driving different screws. The ratchet wheel 31' and the drive shaft 40' are coupled detachably to each other by tongue-and-groove arrangement 43', 331' such that the drive shaft 40' can be reversed relative to the shaft-mounting seat when it is desired to use the tool bit 42' disposed within the handle 20'.

Figure 7:
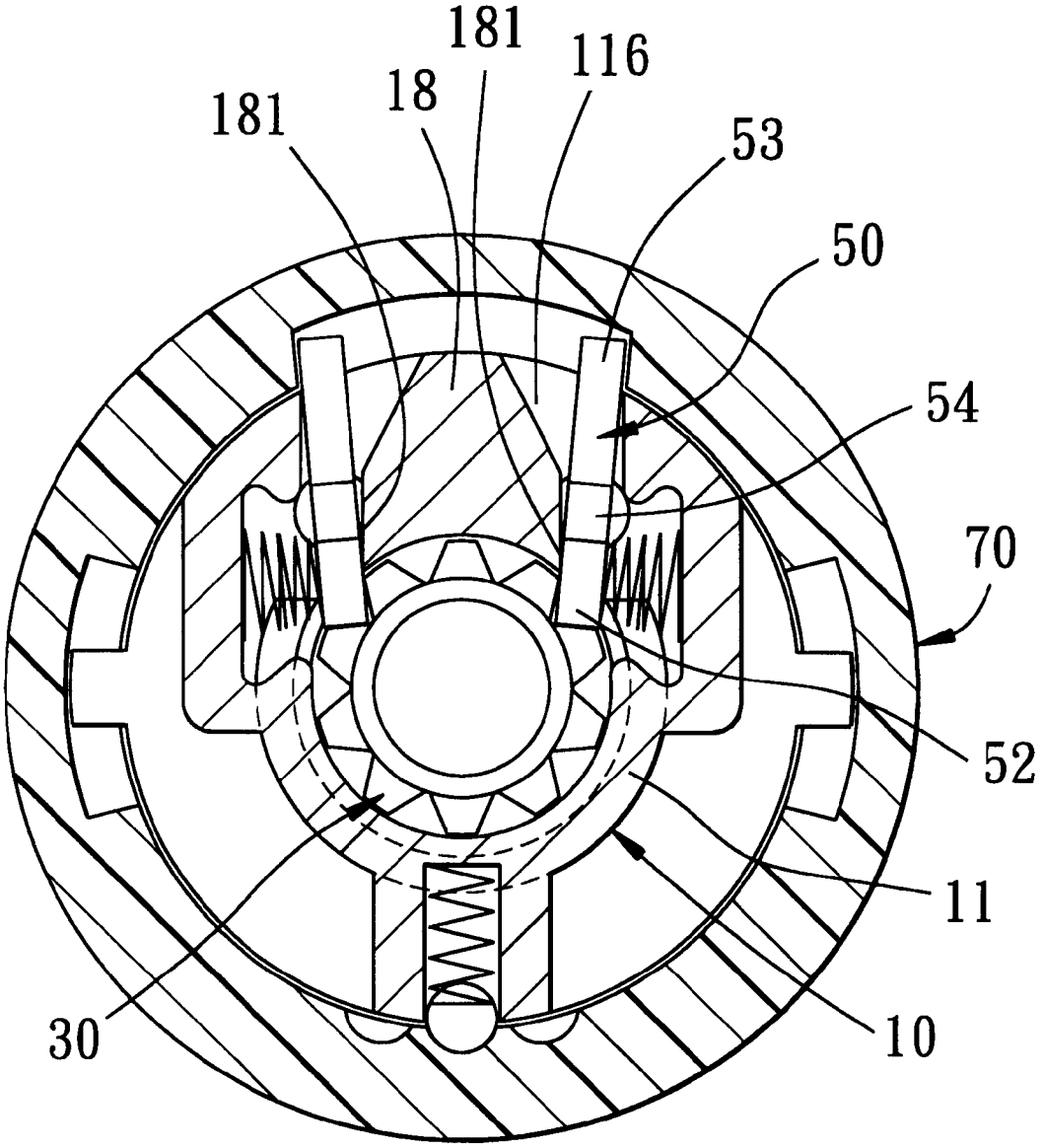
FIG. 7 is a fragmentary sectional view of another modified preferred embodiment according to the present invention.

Referring to FIG. 7, an another modified preferred embodiment of the present invention is shown to have a structure similar to that of the previous embodiment. The main difference resides in that each of the left and right pawls 50 has a constricted neck portion 54 between the actuating portion 53 and the teeth-engaging portion 52. The upper wall portion of the peripheral wall 11 further has an inner protrusion 18 extending inwardly from an inner wall surface confining the shaft-receiving space 12 (see FIG. 1) and located between the pawl-limiting through-holes 116. The inner protrusion 18 has opposing left and right flat faces 181. The right flat face 181 abuts against the constricted neck portion 54 of the right pawl 50 so as to prevent bending of the right pawl 50 when the tubular sleeve 70 is turned about the first axis relative to the shaft-mounting seat 10 to the first angular position. The left flat face 181 abuts against the constricted neck portion 54 of the left pawl 50 so as to prevent bending of the left pawl 50 when the tubular sleeve 70 is turned about the first axis relative to the shaft-mounting seat 10 to the second angular position.

While the present invention has been described in connection with what is considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

I claim:

1. A ratchet screwdriver comprising:

a drive shaft defining a first axis, and having a coupling section, and an operating section which extends axially from said coupling section and which defines a tool-retaining hole with a non-circular cross-section;

a shaft-mounting seat including a peripheral wall that defines a shaft-receiving space to receive said coupling section of said drive shaft therein, and that has front and rear ends, and an upper wall portion formed with two spaced apart opposing spring-retaining recesses in spatial communication with said shaft-receiving space, and two spaced apart opposing pawl-limiting through-holes disposed between said spring-retaining recesses, each of said pawl-limiting through-holes being confined by a hole-confining wall, said shaft-mounting seat further including front and rear end flanges extending inwardly and respectively from said front and rear ends of said peripheral wall in a transverse direction relative to said peripheral wall, said coupling section of said drive shaft extending through said front end flange, said shaft-receiving space, and said rear end flange;

an elongated handle securely connected to said rear end of said shaft-mounting seat; and a ratchet assembly including a ratchet wheel disposed around and connected securely to said coupling section of said drive shaft for co-rotation therewith in said shaft-receiving space, and having a plurality of engaging teeth formed circumferentially therearound, opposing left and right pawls, each of which is disposed in said shaft-receiving space among said drive shaft, a respective one of said spring-retaining recesses, and a respective one of said pawl-limiting through-holes, and each of which has two opposite pivot ends respectively pivoted to said front and rear end flanges, a teeth-engaging portion between said pivot ends, and an actuating portion projecting from said teeth-engaging portion through a respective one of said pawl-limiting through-holes, said pivot ends of each of said left and right pawls being limitedly turnable relative to said shaft-mounting seat about a second axis that is parallel to said first axis and so as to be turnable about said first axis together with said shaft-mounting seat, opposing left and right biasing members disposed in said spring-retaining recesses for urging said teeth-engaging portions of said left and right pawls to releasably mesh with said engaging teeth of said ratchet wheel, respectively, a regulator in the form of a tubular sleeve sleeved rotatably around said peripheral wall of said shaft mounting seat, and having an inner wall that is formed with a sector-shaped recess defined by a recess-confining wall, said tubular sleeve being turnable about said first axis relative to said shaft-mounting seat between a first angular position, where said actuating portion of said left pawl is pushed by said recess-confining wall of said tubular sleeve against biasing action of said left biasing member so as to turn about said second axis to abut against said hole-confining wall of the respective one of said pawl-limiting through-holes and so as to permit said teeth-engaging portion of said left pawl to disengage from said engaging teeth of said ratchet wheel, and where said teeth-engaging portion of said right pawl engages said engaging teeth of said ratchet wheel, and a second angular position opposite to said first angular position, where said actuating portion of said right pawl is pushed by said recess-confining wall of said tubular sleeve against biasing action of said right biasing member so as to turn about said second axis to abut against said hole-confining wall of the other one of said pawl-limiting through-holes and so as to permit said teeth-engaging portion of said right pawl to disengage from said engaging teeth of said ratchet wheel, and where said teeth-engaging portion of said left pawl engages said engaging teeth of said ratchet wheel, and a positioning unit disposed between said shaft-mounting seat and said tubular sleeve for releasably engaging said shaft-mounting seat and said tubular sleeve once said tubular sleeve is moved to said first and second angular positions such that when said tubular sleeve is moved to said first angular position, rotation of said handle in a clockwise direction results in synchronous rotation of said shaft-mounting seat and said drive shaft in said clockwise direction and rotation of said handle in a counterclockwise direction results in idle rotation of said handle relative to said drive shaft, and such that when said tubular sleeve is moved to said second angular position, rotation of said handle in said counterclockwise direction results in synchronous rotation of said shaft-mounting seat and said drive shaft in said counterclockwise direction, and rotation of said handle in said clockwise direction results in idle rotation of said handle relative to said drive shaft.

2. The ratchet screwdriver as defined in claim 1, wherein said inner wall of said tubular sleeve is further formed with spaced apart left and right engaging grooves which are disposed at a position opposite to said sector-shaped recess, said positioning unit including a spring-loaded ball mounted on said shaft-mounting seat and engaging said right engaging groove when said tubular sleeve is moved to said first angular position and engaging said left engaging groove when said tubular sleeve is moved to said second angular position.

3. The ratchet screwdriver as defined in claim 1, wherein said inner wall of said tubular sleeve is further formed with a pair of diametrically disposed limiting grooves at two opposite sides of said sector-shaped recess, said shaft-mounting seat further including a pair of opposing limiting tabs radially and outwardly projecting from said peripheral wall and extending into said limiting grooves, respectively, so as to limit angular rotation of said tubular sleeve to said first and second angular positions relative to said shaft-mounting seat.

4. The ratchet screwdriver as defined in claim 1, wherein each of said left and right pawls further has a constricted neck portion between said actuating portion and said teeth-engaging portion, said upper wall portion of said peripheral wall further has an inner protrusion extending inwardly from an inner wall surface confining said shaft-receiving space and located between said pawl-limiting through-holes, said inner protrusion having opposing left and right flat faces, said right flat face abutting against said constricted neck portion of said right pawl when said tubular sleeve is turned about said first axis relative to said shaft-mounting seat to said first angular position, said left flat face abutting against said constricted neck portion of said left pawl when said tubular sleeve is turned about said first axis relative to said shaft-mounting seat to said second angular position.

* * * * *